US005293449A

United States Patent [19]

Tzeng

[11] Patent Number: 5,293,449

[45] Date of Patent: Mar. 8, 1994

[54] ANALYSIS-BY-SYNTHESIS 2,4 KBPS LINEAR PREDICTIVE SPEECH CODEC

[75] Inventor: Forrest F. Tzeng, Rockville, Md.

[73] Assignee: Comsat Corporation, Bethesda, Md.

[21] Appl. No.: 905,239

[22] Filed: Jun. 29, 1992

Related U.S. Application Data

[63] Continuation of Ser. No. 617,331, Nov. 23, 1990, abandoned.

[51] Int. Cl.[5] ..... G10L 9/14

[52] U.S. Cl. ..... 395/2.32; 395/2.29; 395/2.28

[58] Field of Search ..... 395/2; 381/29-50

[56] References Cited

U.S. PATENT DOCUMENTS

| | | | |
|---|---|---|---|
| Re. 32,590 | 2/1988 | Sakuraya et al. | 55/26 |
| 4,301,329 | 11/1981 | Taguchi | 381/37 |
| 4,393,272 | 7/1983 | Itakura et al. | 395/2 |
| 4,716,592 | 12/1987 | Ozawa et al. | 395/2 |
| 4,791,670 | 12/1988 | Copperi et al. | 395/2 |
| 4,797,926 | 1/1989 | Bronson et al. | 381/36 |
| 4,817,157 | 3/1989 | Gerson | 381/40 |
| 4,860,355 | 8/1989 | Copperi | 381/36 |
| 4,868,867 | 9/1989 | Davidson et al. | 381/36 |
| 4,873,723 | 10/1989 | Shibagaki et al. | 381/34 |
| 4,896,361 | 1/1990 | Gerson | 381/40 |
| 4,963,034 | 10/1990 | Cuperman et al. | 381/36 |
| 4,980,916 | 12/1990 | Zinser | 381/36 |
| 5,060,269 | 10/1991 | Zinser | 381/36 |

OTHER PUBLICATIONS

Copperi et al., "Vector Quantization and Perceptual Criteria for Low-Rate Coding of Speech", ICASSP85 Proceedings, Mar. 26, 1985, Tampa, FL, pp. 252-255.

Tremain, "The Government Standard Linear Predictive Coding Algorithm: LPC-10", Speech Technology, Apr. 1982, pp. 40-49.

C. C. Bell et al., "Reduction of Speech Spectra by analysis-by-Synthesis Techniques", J. Acoust Soc Am., vol. 33, Dec. 1961, pp. 1725-1736.

J. P. Campbell, Jr., T. E. Termain, "Voiced/Unvoiced Classification of Speech With Applications to the U.S. Government LPC-IOE Algorithm", ICASSP 86, Tokyo, pp. 473-476, (undated).

F. F. Tzeng, "Near-Toll-Quality Real-Time Speech Coding at 4.8 KBIT/s for Mobile Satellite Communications", pp.1-6, 8th International Conference on Digital Satellite Communications, Apr. 1989.

P. Koon and B. S. Atal, "Pitch Predictors with High Temporal Resolution", IEEE ICASSP, 1990, pp. 661-664.

(List continued on next page.)

*Primary Examiner*—David D. Knepper

*Attorney, Agent, or Firm*—Sughrue, Mion, Zinn, Macpeak & Seas

[57] ABSTRACT

A linear predictive speech codec arrangement including: a spectrum synthesizer for providing reconstructed speech generation in response to excitation signals; a distortion analyzer for comparing the reconstructed speech with an original speech, and providing a distortion analysis signal in response to such comparison; and an excitation model circuit for providing excitation signals to the spectrum synthesizer, with the excitation model circuit receiving and utilizing the distortion analysis signal in an analysis-by-synthesis operation, for determining ones of excitation signals which provide an optimal reconstructed speech. The excitation model circuit can include: a voiced excitation generator and a Gaussian noise generator, both of which should optimally provide a plurality of available excitation signal models. The voiced excitation generator and Gaussian noise generator can be in the form of a codebook of a plurality of possible pulse trains and Gaussian sequences, respectively, or alternatively, the voiced excitation generator can be in the form of a first order pitch synthesizer. The optimal excitation signal and/or the pitch value and the pitch filter coefficient are determined using an analysis-by-synthesis technique.

9 Claims, 3 Drawing Sheets

OTHER PUBLICATIONS

M. Young, G. Davidson and A. Gersho, "Encoding of LPC Spectral Parameters Using Switched-Adaptive Interframe Vector Prediction", pp. 402–405, Dept. of Electrical and Computer Engineering, Univ. of CA., Santa Barbara, 1988.

M. R. Schroeder and B. S. Atal, "Code-Excited Linear Prediction (CELP) High Quality Speech at Very Low Bit Rates", pp. 937–940, 1985.

B. S. Atal and J. R. Remde, "A New Model of LPC Excitation for Producing Natural-Sounding Speech at Low Bit Rates", pp. 614–617, 1982.

L. R. Rabiner, M. J. Cheng, A. E. Rosenberg and C. A. McGonegal, "A Comparative Performance Study of Several Pitch Detection Algorithm", IEEE Trans. Acoust., Speech, and Signal Process., vol. ASSP-24, pp. 399–417, Oct. 1976.

ANALYSIS-BY-SYNTHESIS 2,4 KBPS LINEAR PREDICTIVE SPEECH CODEC

This is a continuation of application Ser. No. 07/617,331 filed Nov. 23, 1990 now abandoned.

FIELD OF THE INVENTION

The subject invention is directed to a speech codec (i.e., coder/decoder) with improved speech quality and noise robustness, and more particularly, is directed to a speech codec in which the excitation signal is optimized through an analysis-by-synthesis procedure, without making a prior V/UV decision or pitch estimate.

BACKGROUND OF THE INVENTION

Speech coding approaches which are known in the art include:

Taguchi (U.S. Pat. No. 4,301,329) Itakura et al. (U.S. Pat. No. 4,393,272) Ozawa et al. (U.S. Pat. No. 4,716,592) Copperi et al. (U.S. Pat. No. 4,791,670) Bronson et al. (U.S. Pat. No. 4,797,926) Atal et al. (Re. U.S. Pat. No. 32,590)

C. G. Bell et al., "Reduction of Speech Spectra by Analysis-by-Synthesis Techniques," *J Acoust Soc Am,* Vol 33, Dec. 1961, pp. 1725–1736

F. Itakura, "Line Spectrum Representation of Linear Predictive Coefficients of Speech Signals," *J Acoust Soc Am,* Vol. 57, Supplement No. 1, 1975, p. 535

G. S. Kang and L. J. Fransen, "Low-Bit-Rate Speech Encoders Based on Line Spectrum Frequencies (LSFs)", Naval Research Laboratory Report No. 8857, Nov. 1984

S. Maitra and C. R. Davis, "Improvements on the Classical Model for Better Speech Quality," IEEE International Conference on Acoustics, Speech, and Signal Processing, pp. 23–27, 1980

M. Yong, G. Davidson and A. Gersho, "Encoding of LPC Spectral Parameters Using Switched-Adaptive Interframe Vector Prediction", pp. 402–405, Dept. of Electrical and Computer Engineering, Univ. of California, Santa Barbara, 1988

M. R. Schroeder and B. S. Atal, "Code-Excited Linear Prediction (CELP) High-Quality Speech at Very Low Bit Rates", pp. 937–940, 1985

B. S. Atal and J. R. Remde, "A New Model of LPC Excitation for Producing Natural-Sounding Speech at Low Bit Rates", pp. 614–617, 1982

L. R. Rabiner, M. J. Cheng, A. E. Rosenberg and C. A. McGonegal, "A Comparative Performance Study of Several Pitch Detection Algorithms", IEEE Trans. Acoust., Speech, and Signal Process., vol. ASSP-24, pp. 399–417, Oct. 1976

J. P. Campbell, Jr,. T. E. Termain, "Voiced/Unvoiced Classification of Speech With Applications to the U.S. Government LPC-10E Algorithm", ICASSP 86, TOKYO, pp. 473–476, (undated)

P. Kroon and B. S. Atal, "Pitch Predictors with High Temporal Resolution", Proc. IEEE ICASSP, 1990, pp. 661–664

F. F. Tzeng, "Near-Toll-Quality Real-Time Speech Coding at 4.8 KBIT/s for Mobile Satellite Communications:, pp. 1–6, 8th International Conference on Digital Satellite Communications, April 1989

The teachings of the above and any other references mentioned throughout the specification are incorporated herein by reference for the purpose of indicating the background of the invention and/or illustrating the state of the art.

A 2.4 kbps linear predictive speech coder, with an excitation model as shown in FIG. 1 (indicated as 100), has found wide-spread military and commercial applications. A spectrum synthesizer 102 (e.g., a 10th-order all-pole filter), used to mimic a subject's speech generation (i.e., vocal) system, is driven by a signal from a G gain amplifier 104, to produce reconstructed speech. The gain amplifier 104 receives and amplifies a signal from a voiced/unvoiced (V/UV) determination means 106. With respect to an operation of the voiced/unvoiced determination means, for each individual speech frame, a decision is made as to whether the frame of interest is a voiced or an unvoiced frame.

The voiced/unvoiced determination means makes a "voiced" determination, and correspondingly switches a switch 107 to a "voiced" terminal, during times when the sounds of the speech frame of interest are vocal cord generated sounds, e.g., the phonetic sounds of the letters "b", "d", "g", etc. In contrast, the voiced/unvoiced determination means makes an "unvoiced" determination and correspondingly switches the switch 107 to an "unvoiced" terminal during times when the sounds of the speech frame of interest are non-vocal cord generated sounds, e.g., the phonetic sounds of the letters "p", "t", "k", "s", etc. For a voiced frame, a pulse train generator 108 estimates a pitch value of the speech frame of interest, and outputs a pulse train, with a period equal to the pitch value, to the voiced/unvoiced determination means for use as an excitation signal. For an unvoiced frame, a Gaussian noise generator 110 generates and outputs a white Gaussian sequence for use as an excitation signal.

A typical bit allocation scheme for the above-described model is as follows: For a speech signal sampled at 8 KHz, and with a frame size of 180 samples, the available data bits are 54 bits per frame. Out of the 54 bits, 41 bits are allocated for the scalar quantization of ten spectrum synthesizer coefficients (5,5,5,5,4,4,4,4,3 and 2 bits for the ten coefficients, respectively), 5 bits are used for gain coding, 1 bit to specify a voiced or an unvoiced frame, and 7 bits for pitch coding.

This above-described approach is generally referred to in the art as an LPC-10. Such LPC-10 coder is able to produce intelligible speech, which is very useful at a low data rate. However, the reconstructed speech is not natural enough for many other applications.

The major reason for the LPC-10's limited success is the rigid binary excitation model which it adopts. However, at 2.4 kbps, use of an over-simplified excitation model is a necessity. As a result of the arrangement of the LPC-10, performance depends critically on a correct V/UV decision and accurate pitch estimation and tracking. Many complicated schemes have been proposed for the V/UV decision and pitch estimation/tracking; however, no completely satisfactory solutions have been found. This is especially true when the desired speech signal is corrupted by the background acoustic noises, or when a multi-talker situation occurs.

Another drawback of the LPC-10 approach is that when a frame is determined as unvoiced, the seven bits allocated for the pitch value are wasted. Also, since open-loop methods are used for the V/UV decision and pitch estimation/tracking, the synthesized speech is not perceptually reconstructed to mimic the original speech, regardless of the complexity of the V/UV decision rule and the pitch estimation/tracking strategy.

Accordingly, the above-described scheme provides no guarantee of how close the synthesized speech will be to the original speech in terms of some pre-defined distortion measures.

SUMMARY OF THE INVENTION

The present invention is directed toward providing a codec scheme which addresses the aforementioned shortcomings, and provides improved distortion performance and increased efficiency of data bit use.

Analysis-by-synthesis methods (e.g., see Bell, supra.), or closed-loop analysis methods, have long been used in areas other than speech coding (e.g., control theory). The present invention applies an analysis-by-synthesis (i.e., feedback) method to speech coding techniques. More particularly, the invention is directed to a speech codec utilizing an analysis-by-synthesis scheme which provides improved speech quality, noise robustness, and increased efficiency of data bit use. In short, the approach of the subject invention significantly reduces distortion over that obtainable using any other V/UV decision rule and pitch estimation/tracking strategy, no matter how complicated.

The present linear predictive speech codec arrangement comprises: a spectrum synthesizer for providing reconstructed speech generation in response to excitation signals; a distortion analyzer for comparing the reconstructed speech with an original speech, and providing a distortion analysis signal in response to such comparison; and, an excitation model circuit for providing the excitation signals to the spectrum synthesizer means, with the excitation model circuit receiving and utilizing the distortion analysis signal in an analysis-by-synthesis operation, for determining ones of the excitation signals which provide an optimal reconstructed speech.

The excitation model means can comprise: a voiced excitation generator and a Gaussian noise generator, both of which should optimally provide a plurality of available excitation signal models. The voiced excitation generator and Gaussian noise generator can be in the form of a codebook of a plurality of possible pulse trains and Gaussian sequences, respectively, or alternatively, the voiced excitation generator can be in the form of a first order pitch synthesizer. The optimal excitation signal and/or the pitch value and the pitch filter coefficient are determined using analysis-by-synthesis.

While a speech is being reconstructed, the spectrum synthesizer memory may also impress some inherent effects or characteristics on the reconstructed speech. The distortion analyzer means can comprise an arrangement negating such effects or characteristics before a reconstructed speech comparison is performed, i.e., the distortion analyzer means can comprise a "speech minus spectrum synthesizer memory" arrangement for storing a residual speech for closed-loop excitation analysis. Further included in the distortion analyzer means is a subtractor for receiving a reconstructed speech and subtracting therefrom the residual speech delivered from the "speech minus spectrum synthesizer memory" arrangement.

Further, a perceptual weighting circuit can be used to introduce a perceptual weighting effect on the mean-squared-error (MSE) distortion measure with regard to a reconstructed speech.

In addition to disclosure of the basic theory of the present invention, five excitation models are disclosed. It should be noted that the new schemes achieve better speech quality and stronger noise robustness at the cost of a moderate increase in computational complexity. However, the coder complexity can still be handled using a single digital signal processor (DSP) chip.

DETAILED DESCRIPTION OF THE PREFERRED EMBODIMENTS OF THE INVENTION

Figure 2:
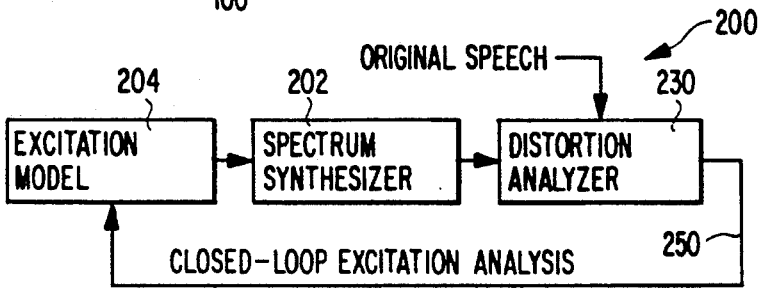
FIG. 2 is a schematic diagram an encoder utilizing the analysis-by-synthesis approach of the present invention.

A schematic diagram of a speech coder of the present invention is shown in FIG. 2. A spectrum synthesizer 202 (e.g., a 10th-order all-pole filter), used to mimic a subject's speech generation (i.e., vocal) system, is driven by a signal from an excitation model circuit 204, to produce reconstructed speech. A distortion analyzer 230 receives the reconstructed speech and an original speech, compares the two, and outputs a distortion analysis. The distortion analysis is delivered to the excitation model circuit 204 via a feedback path 250, to provide closed-loop excitation analysis (i.e., distortion feedback).

The excitation model circuit 204 can use the excitation analysis from such closed-loop method to compare distortion results from a plurality of possible excitation signals, and thus, in essence, implicitly performs optimization of a V/UV decision and pitch estimation/tracking, and selection of excitation signals which produce optimal reconstructed speech. However, it should be noted that neither a prior V/UV decision, nor a prior pitch estimation is made. Accordingly, the above-described scheme provides (via feedback adjustment) a guarantee of how close the synthesized speech will be to the original speech in terms of some predefined distortion measures. More particularly, with a perceptually meaningful distortion measure, the analysis part of a speech coding scheme can be optimized to minimize a chosen distortion measure. The preferred distortion measure is a perceptually weighted mean-squared error (WMSE), because of its mathematical tractability.

Once the excitation model 204 has utilized the excitation analysis to select an excitation signal which produces optimal reconstructed speech, data as to the excitation signal is forwarded to a receiver (e.g., decoder stage) which can utilize such data to produce optimal reconstructed speech.

For each speech frame, the coefficients of the spectrum synthesizer are computed and each codeword in both the voiced and unvoiced codebooks is used together with its corresponding gain term to determine a codeword/gain term pair that will result in a minimum perceptually-weighted distortion measure. This implicitly performs the voiced/unvoiced decision while optimizing this decision and the resulting pitch value in terms of minimizing distortion for a current speech frame.

FIG. 2's speech coder includes an output circuit for providing (via wireless or satellite transmission, etc), for speech reconstruction at a decoder, coded output signals according to a 54 bit per speech frame coding scheme. In a preferred embodiment, 26 bits of the 54 are used to define parameters for the spectrum synthesizer once per frame, and 28 bits are utilized to define a selected optimum excitation signal model once or twice per frame. A preferred bit allocation of the 28 bits will be discussed below with respect to each model example.

In summary of FIG. 2's speech coder, with an assumed excitation model, given original speech and spectrum synthesizer, a closed-loop analysis method is used to compute the parameters of the excitation model that are to be coded and transmitted to the receiver. The computed parameter set is optimal in the sense of minimizing the predefined distortion measure between the original speech and the reconstructed speech. The simplicity of a preferred WMSE distortion measure reduces the amount of computation required in the analysis. It is also subjectively meaningful for a large class of waveform coders. For low-data-rate speech coders, other distortion measures (e.g., some spectral distortion measures) might be more subjectively meaningful. Nevertheless, the design approaches proposed here are still directly applicable.

Figure 3:
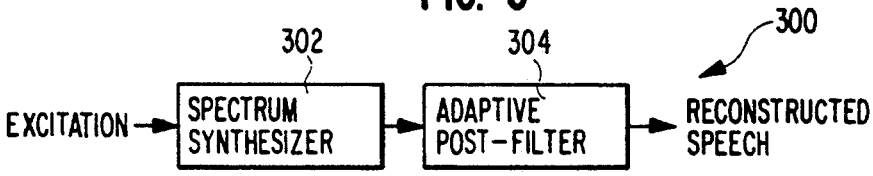
FIG. 3 is a schematic diagram of a decoder utilizing the analysis-by-synthesis approach of the present invention.

FIG. 3 shows a speech decoder (i.e., receiver) of the present invention. In such decoder, a spectrum synthesizer 302 (e.g., a 10th-order all-pole filter), used to mimic a subject's speech generation (i.e., vocal) system, is driven by a signal (54 bit per speech frame coding scheme) for an excitation model instructed from FIG. 2's encoder. Signals from the spectrum synthesizer 302 are delivered to an adaptive post-filter 304. As the excitation signals utilized by the decoder include the optimal V/UV decision and pitch estimation/tracking data, FIG. 3's decoder arrangement can produce optimal reconstructed speech.

The analysis-by synthesis decoder of FIG. 3 is similar to that of a conventional LPC-10, except that an adaptive post-filter has been added to enhance the perceived speech quality. The transfer function of the adaptive post-filter is given as $$Q(z) = \frac{(1 - \mu z^{-1})A(z/a)}{A(z/b)} \quad (1)$$

where $$A(z) = 1 - \sum_{i=1}^{10} a_i z^{-1}$$

is the transfer function of the spectrum filter; $0<a<b<1$ are design parameters; and $\mu=cK_1$, where $0<c<1$ is a constant and $K_1$ is the first reflection coefficient.

The perceptual weighting filter, W(z), used in the WMSE distortion measure is defined as $$W(z) = \frac{A(z)}{A(z/\gamma)} \quad (2)$$

where $0<Y<1$ is a constant controlling the amount of spectral weighting.

For spectrum filter coding, a 26-bit interframe predictive scheme with two-stage vector quantization is used. The interframe predictor can be formulated as follows. Given the parameter Set of the current frame, $$F_n=(f_n^{(1)},f_n^{(2)},\ldots,f_n^{(10)})^T$$

for a 10th-order spectrum filter, the predicted parameter set is $$\hat{F}_n=MF_{n-1} \quad (3)$$

where the optimal prediction matrix, M, which minimizes the mean-squared prediction error, is given by $$M=[E(F_nF_{n-1}^T)][E(F_{n-1}F_{n-1}^T)^{-1} \quad (4)$$

where E is the expectation operator.

Because of their smooth behavior from frame to frame, the line-spectrum frequencies (LSFs) (see Itakura, supra.) are chosen as the parameter set. For each frame of speech, a linear predictive analysis is performed to extract 10 predictor coefficients, which are then transformed into the corresponding LSF parameters. For interframe prediction, a mean LSF vector (which is precomputed using a large speech database) is first subtracted from the LSF vector of the current frame. Then, a 6-bit codebook of predictor matrices (which is also precomputed using the same speech database) is exhaustively searched to find the predictor matrix, M, that minimizes the mean-squared prediction error. The predicted LSF vector for the current frame $\hat{F}_n$ is then computed. The residual LSF vector, which results as the difference vector between the current frame LSF vector $F_n$ and the predicted LSF vector ($\hat{F}_n$), is then quantized by a two-stage vector quantizer. Each vector quantizer contains 1,024 (10-bit) vectors.

To improve coding performance, a perceptual weighting factor is included in the distortion measure used for the two-stage vector quantizer. The distortion measure is defined as $$D = \sum_{i=1}^{10} w_i(x_i - y_i)^2 \quad (5)$$

where $x_i$, $y_i$ denotes the component of the LSF vector to be quantized, and the corresponding component of each codeword in the codebook, respectively. The corresponding perceptual weighting factor, $w_i$, is defined as (see Kang, supra.)

$$w_i = \begin{cases} u(f_i)\sqrt{D_i/D_{max}}, & 1.375 \leqq D_i \leqq D_{max} \\ u(f_i)\, d_i/\sqrt{1.375\, D_{max}}, & D_i < 1.375 \end{cases} \quad (6)$$

where

-continued $$u(f_i) = \begin{cases} 1, f_i < 1{,}000\text{Hz} \\ \frac{-0.5}{3000}(f_i - 1{,}000) + 1, 1{,}000 \leqq f_i \leqq 4{,}000\text{Hz} \end{cases} \quad (7)$$

The factor $u(f_i)$ accounts for the human ear's insensitivity to the high-frequency quantization inaccuracy; $f_i$ denotes the i-th component of the LSFs for the current frame; $D_i$ denotes the group delay for $f_i$ in milliseconds; and $D_{max}$ is the maximum group delay, which has been found experimentally to be around 20 ms. The group delay ($D_i$) accounts for the specific spectral sensitivity of each frequency ($f_i$), and is well related to the formant structure of the speech spectrum. At frequencies near the formant region, the group delays are larger. Therefore, those frequencies should be more accurately quantized, and hence the weighting factors should be larger.

The group delays ($D_i$) can easily be computed as the gradient of the phase angles of the ratio filter (See. Kang, supra.) at $-n\pi(n=1, 2, \ldots, 10)$. These phase angles are computed in the process of transforming the predictor coefficients of the spectrum filter to the corresponding LSFs.

Five excitation models are proposed for the analysis-by-synthesis LPC-10 of the present invention.

Excitation Model 1

Figure 4:
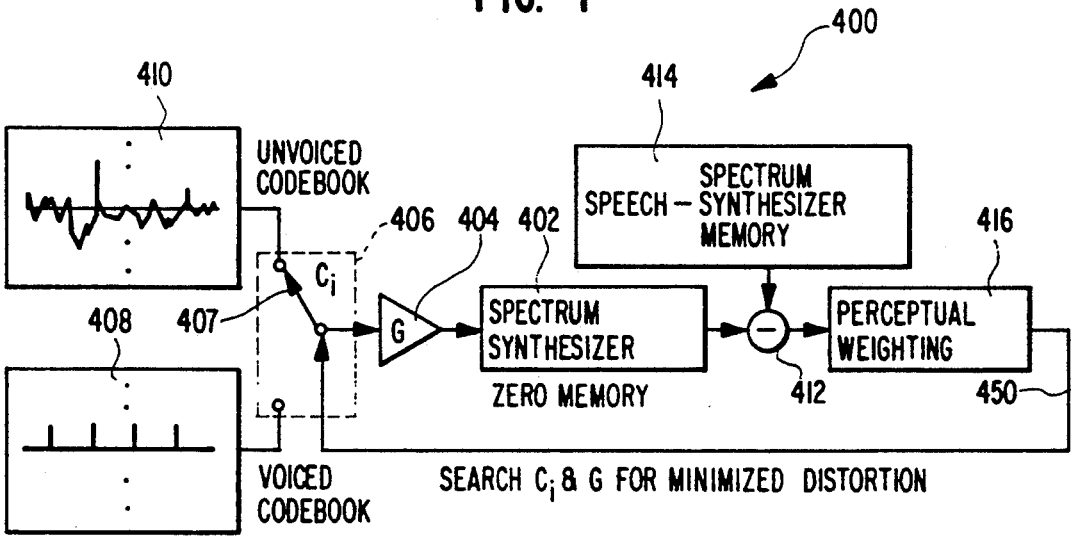
FIG. 4 is a schematic diagram of a first excitation model of the speech coder of the present invention.

FIG. 4 is a schematic diagram of a first excitation model of the speech coder of the present invention. A spectrum synthesizer 402 (e.g., a 10th-order all-pole filter), used to mimic a subject's speech generation (i.e., vocal) system, is driven by a signal from a G gain amplifier 404, to produce reconstructed speech. The gain amplifier 404 receives and amplifies a signal from an excitation model circuit 470. With respect to an operation of the excitation model circuit, the excitation model circuit sequentially applies (using a switching means 407) each possible excitation signal of a plurality of possible excitation signal to the gain amplifier. The excitation model circuit receives a distortion analysis signal for each applied excitation signal, compares the distortion analysis signals, and determines ones of the excitation signals which provide an optimal reconstructed speech.

The excitation model circuit can comprise: a voiced excitation generator and a Gaussian noise generator, both of which provide a plurality of available excitation signals. The pulse train generator and Gaussian noise generator (FIG. 4) are in the form of a codebook of a plurality of possible pulse trains and Gaussian sequences (i.e., codewords), respectively. The optimal excitation signal and/or the pitch value and the gain are determined using analysis-by-synthesis.

As mentioned previously, while a speech is being reconstructed, the spectrum synthesizer 402 memory may also impress some inherent effects or characteristics on the reconstructed speech. As further circuit components, the embodiment in FIG. 4 can comprise an arrangement negating such effects or characteristics before a reconstructed speech comparison is performed, i.e., FIG. 4's embodiment can comprise a "speech minus spectrum synthesizer memory" arrangement 414 for producing or storing a residual speech for closed-loop excitation analysis. A subtractor 412 also is included for receiving a reconstructed speech and subtracting therefrom the residual speech delivered from the "speech minus spectrum synthesizer memory" arrangement.

The output from the subtractor 412 is then applied to a perceptual weighting MSE circuit 416 which introduces a perceptual weighting effect on the mean-squared-error distortion measure, which is important in low-data-rate speech coding. The output from the perceptual weighting MSE circuit 416 is delivered to the excitation model circuit 470 via a feedback path 450, to provide closed-loop excitation analysis (i.e., distortion feedback).

According to FIG. 4's embodiment, there is not only a codebook of 128 different pulse trains (i.e., voiced excitation models), but also an unvoiced codebook of 128 different random Gaussian sequences (i.e., unvoiced excitation models). More particularly, one difference between FIG. 4's coder arrangement and that of FIG. 1's, is the use of a codebook (i.e., having a menu of possible excitation signal models) arrangement for the voiced excitation generator 408 and the Gaussian noise generator 410. For an analysis-by-synthesis operation, a voiced excitation generator 408 outputs each of a plurality of possible codebook pulse trains, with each possible codebook pulse train having a different pitch period. Similarly, the Gaussian noise generator 410 outputs each of a plurality of possible Gaussian sequences for use as an excitation signal, with each Gaussian sequence having a different random sequence.

Figure 1:
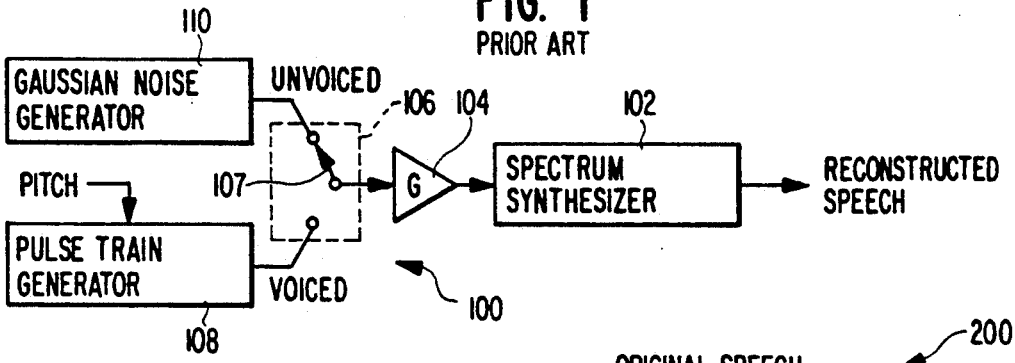
FIG. 1 PRIOR ART
FIG. 1 is a schematic diagram of a conventional LPC-10 scheme with binary excitation.

A further difference from FIG. 1's LPC-10 is that one bit is used, not to specify a voiced or an unvoiced speech frame, but rather to indicate which excitation codebook (voiced or unvoiced) is the source of the best excitation codeword. For the voiced codebook, 7 bits are used to specify a total of 128 pulse trains, each with a different value of periodicity which corresponds to different pitch values with a range from 16 to 143 samples, and six bits are used to specify the corresponding power gain. For the unvoiced codebook, the 7 bits are used to specify a total of 128 random sequences, and 5 bits are used to encode the power gain. (In the case of unvoiced sound with FIG. 1's LPC-10 arrangement, the 7 bits, used in the present invention to select from the voiced codebook, are wasted.) The foregoing data bit arrangement evidences the fact that present invention is also advantageous over FIG. 1's LPC-10 arrangement in terms of efficiency of use of available data bits. In a preferred embodiment, excitation information is updated twice per frame.

For each speech frame, the coefficients of the spectrum synthesizer are computed. Then, FIG. 4's embodiment performs (within the time period of one frame, or in a preferred embodiment, one-half frame) a series of analysis operations wherein each codeword ($C_i$) in both the unvoiced and voiced excitation codebooks is used, together with its corresponding gain term (G), as the input signal to the spectrum synthesizer. Codeword $C_i$, together with its corresponding gain G, which minimizes the WMSE between the original speech and the synthesized speech, is selected as the best excitation. The perceptual weighting filter is given in equation (2) above.

In FIG. 4's embodiment, 28 bits are utilized to define a selected optimum excitation signal model twice per frame, with each of two 14 bit groups from said 28 bits being allocated as follows: 1 bit to designate one of a voiced and unvoiced excitation model; if a voiced model is designated, 7 bits are used to define a pitch value and 6 bits are used to define a gain; and, if an unvoiced model is designated, 8 bits being used to designate an excitation signal model from an unvoiced codebook, and 5 bits being used to define a gain.

Figure 5:
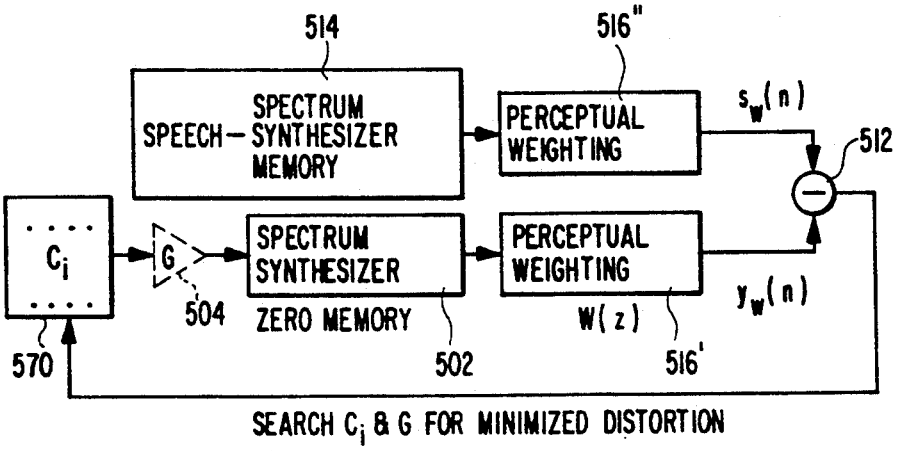
FIG. 5 is a schematic diagram showing how to perform closed-loop excitation analysis which is applicable to all the excitation models.

FIG. 5 is a schematic diagram showing how to perform closed-loop excitation analysis which is applicable to all the excitation models. A spectrum synthesizer 502 (e.g., a 10th-order all-pole filter), used to mimic a subject's speech generation (i.e., vocal) system, is driven by a signal from a gain amplifier 504, to produce reconstructed speech. The gain amplifier 504 receives an excitation signal from excitation model circuit 570, which, for example, may contain FIG. 4's arrangement of the switch 407, voice excitation generator 408 and Gaussian noise generator 410.

As further circuit components, the output from the spectrum synthesizer 502 is applied to a perceptual weighting circuit 516'. The output from a "speech minus spectrum synthesizer memory" arrangement 514 is applied to a perceptual weighting circuit 516''. A subtractor 512 receives the outputs from the perceptual weighting circuits 516' and 516'', and the output from the subtractor is delivered through an MSE compute circuit 520 to the excitation model circuit 570. Such arrangement can be utilized to minimize a distortion measure.

The minimization of the distortion measure can be formulated (see FIG. 5) as $$\text{Minimize } E_w(G, C_i) = \sum_{n=1}^{N} [S_w(n) - GY_w(n)]^2 \tag{8}$$

where N is the total number of samples in an analysis frame; $S_w(n)$ denotes the weighted residual signal after the memory of the spectrum synthesizer has been subtracted from the speech signal; and $Y_w(n)$ denotes the combined response of the filter $1/A(Z)$ and $W(Z)$ to the input signal $C_i$, where $C_i$ is the codeword being considered. The optimum value of the gain term, G, can be derived as $$G = \sum_{n=1}^{N} S_w(n)Y_w(n) / \sum_{n=1}^{N} Y_w^2(n) \tag{9}$$

The excitation codeword ($C_i$) which maximizes the following term is selected as the best excitation codeword:

$$E_w(C_i) = \left[\sum_{n=1}^{N} S_w(n)Y_w(n)\right]^2 / \sum_{n=1}^{N} Y_w^2(n) \tag{10}$$

It should be noted that the random sequences used in the unvoiced excitation codebook can be replaced by the multipulse excitation codewords. Also, techniques which modify the voiced excitation signals in the voiced excitation codebook can be employed without modifying the proposed approach. These techniques are used in the LPC-10 scheme (e.g., the selection of the position of the first pulse, and the insertion of small negative pulses into the positive pulse train to eliminate the positive bias).

The distinctive features of the model 1 speech coder scheme are as follows:

a. The V/UV decision and the pitch estimation/tracking are implicitly performed by minimizing the perceptually weighted distortion measure. Also, the V/UV decision and the pitch value thus found are optimum in terms of minimizing the distortion measure for the current speech frame, irrespective of whether the speech of interest is clean speech, noisy speech, or multitalker speech.
b. The perceptual weighting effect, which is important in low-data-rate speech coding, is easily introduced.
c. Speech coder performance is further improved by using 8 bits to specify 256 random sequences for the unvoiced codebook, instead of wasting them and using only one random sequence.

Excitation Model 2

Figure 6:
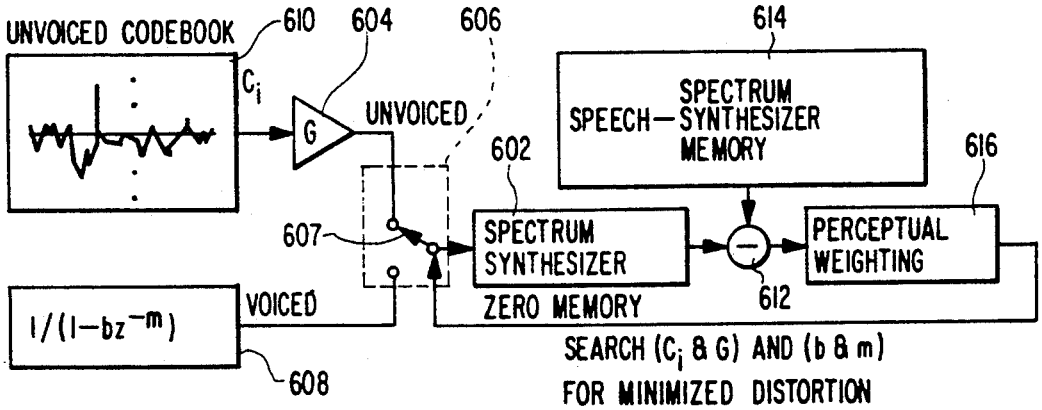
FIG. 6 is a schematic diagram of a second excitation model of the speech coder of the present invention.

FIG. 6 is a schematic diagram of a second excitation model of the speech coder of the present invention. A spectrum synthesizer 602 (e.g., a 10th order all-pole filter), used to mimic a subject's speech generation (i.e., vocal) system, is driven by a signal from an excitation model circuit 670, to produce reconstructed speech. With respect to an operation of the excitation model circuit, for each individual speech frame, the excitation model circuit sequentially applies (using a switching means 607) each possible excitation signal model of a plurality of possible excitation signal models to the gain amplifier. The excitation model circuit receives a distortion analysis signal for each applied excitation signal and then compares the distortion analysis signals for determining ones of the excitation signals which provide an optimal reconstructed speech.

FIG. 6's excitation model circuit comprises a pitch synthesizer and a Gaussian noise generator, both of which provide a plurality of available excitation signal. The Gaussian noise generator is in the form of a codebook of a plurality of possible Gaussian sequences (i.e., codewords), such as that shown and described with respect to FIG. 4. FIG. 6's voiced excitation generator is in the form of a first order pitch synthesizer. The optimal Gaussian sequence (i.e., codeword) and/or the pitch value and the pitch filter coefficient are determined using analysis-by-synthesis.

As further circuit components, the embodiment in FIG. 6 can comprise an arrangement negating spectrum synthesizer 602 memory induced effects or characteristics before a reconstructed speech comparison is performed, i.e., FIG. 6's embodiment can comprise a "speech minus spectrum synthesizer memory" arrangement 614 for storing a residual speech for closed-loop excitation analysis. Further included, is a subtractor 612 for receiving a reconstructed speech and subtracting therefrom the residual speech delivered from the "speech minus spectrum synthesizer memory" arrangement.

The output from the subtractor 612 is then applied to a perceptual weighting MSE circuit 616 which introduces a perceptual weighting effect on the mean-squared-error distortion measure, which is important in low-data-rate speech coding. The output from the perceptual weighting MSE circuit 616 is delivered to the excitation model circuit 670 via a feedback path 650, to provide closed-loop excitation analysis (i.e., distortion feedback).

According to FIG. 6's embodiment, there is an unvoiced codebook 610 of 128 different random Gaussian sequences. FIG. 6's scheme is similar to model 1 (FIG. 4), except that a first-order pitch synthesizer 608 (where m and b denote the pitch period and pitch synthesizer coefficient, respectively) replaces the voiced excitation codebook. The bit allocation remains the same; however, the power gain associated with the voiced codebook now becomes the pitch synthesizer coefficient b. Five bits usually are enough to encode the coefficient of a first-order pitch synthesizer. With 6 bits assigned, it is possible to extend the first-order pitch synthesizer to a third-order synthesizer. The three coefficients are then treated as a vector and quantized using a 6-bit vector quantizer.

The closed-loop analysis method for a pitch synthesizer is similar to the closed-loop excitation analysis method described above. The only difference is that, in FIG. 6, the power gain (G) and the excitation codebook are replaced by the pitch synthesizer 1/P(z), where $P(z)=1-bz^{-m}$. The analysis method is described below.

Assuming zero input to the pitch synthesizer, the input signal X(n) to the spectrum synthesizer is given by X(n)=bX(n-m). Let $Y_w(n)$ be the combined response of the filters 1/A(z) and W(z) to the input X(n), then $Y_w(n)=bY_w(n-m)$. The pitch value, m, and the pitch filter coefficient, b, are determined so that the distortion between $Y_w(n)$ and $S_w(n)$ is minimized. Here, $S_w(n)$ is again defined as the weighted residual signal after the memory of filter 1/A(Z) has been subtracted from the speech signal. The distortion measure between $Y_w(n)$ and $S_w(n)$ is defined as $$E_w(m, b) = \sum_{n=1}^{N} [S_w(n) - Y_w(n)]^2 = \sum_{n=1}^{N} [S_w(n) - bY_w(n-m)] \quad (11)$$

where N is the analysis frame length.

For optimum performance, the pitch value m and pitch filter coefficient b should be searched simultaneously for a minimum $E_w(m, b)$. However, it was found that a simple sequential solution of m and b does not introduce significant performance degradation. The optimum value of b is given by $$b = \frac{\sum_{n=1}^{N} S_w(n)Y_w(n-m)}{\sum_{n=1}^{N} Y_w^2(n-m)} \quad (12)$$

and the minimum value of $E_w(m, b)$ is given by $$E_w(m) = \sum_{n=1}^{N} S_w^2(n) - \frac{\left[\sum_{n=1}^{N} S_w(n)Y_w(n-m)\right]^2}{\sum_{n=1}^{N} Y_w^2(n-m)} \quad (13)$$

Since the first term is fixed, minimizing $E_w(m)$ is equivalent to maximizing the second term. The second term is computed for each value of m in the given range (16 to 143 samples), and the value which maximizes the term is chosen as the pitch value. The pitch filter coefficient, b, is then found from equation (12).

In FIG. 6's embodiment, 28 bits are utilized to define a selected optimum excitation signal model twice per frame, with each of two 14 bit groups from said 28 bits being allocated as follows: one bit to designate one of a voiced and unvoiced excitation model; if a voiced model is designated, 7 bits are used to define a pitch value and 6 bits are used to define a pitch filter coefficient; and, if an unvoiced model is designated, 8 bits being used to designate an excitation signal model from an unvoiced codebook, and 5 bits being used to define a gain.

Excitation Model 3

Figure 7:
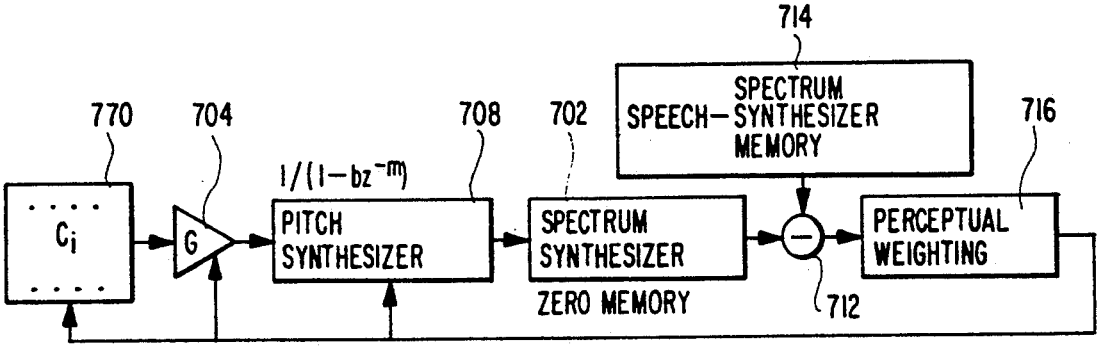
FIG. 7 is a schematic diagram of a third excitation model of the speech coder of the present invention.

FIG. 7 is a schematic diagram of a third excitation model of the speech coder of the present invention. A spectrum synthesizer 702 (e.g., a 10th-order all-pole filter), used to mimic a subject's speech generation (i.e., vocal) system, is driven by a signal from a pitch synthesizer 708, to produce reconstructed speech. The pitch synthesizer 708 receives a signal from gain amplifier 704 which receives a signal from a block circuit 770 which may be in the form of FIG. 6's unvoiced codebook 610.

FIG. 7's remaining components 712, 714, 716 and 750 operate similarly to FIG. 6's components 612, 614, 616 and 650, except that the feedback path 750 provides closed-loop excitation analysis to the pitch synthesizer 708, gain amplifier 704 and the block circuit 770.

The excitation signal applied to the spectrum synthesizer 702 is formed by filtering the selected random sequence through the selected pitch synthesizer 708. For the closed-loop excitation analysis, a suboptimum sequential procedure is used. This procedure first assumes zero input to the pitch synthesizer and employs the closed-loop pitch synthesizer analysis method to compute the parameters m and b. Parameters m and b are fixed, and a closed-loop method is then used to find the best excitation random sequence ($C_i$) and compute the corresponding gain (G).

The bit assignment for this scheme is as follows: 10 bits are used to specify 1,024 random sequences for the excitation codebook, 7 bits are allocated for pitch m, and 5 bits each are allocated for the power gain and the pitch synthesizer coefficient, respectively. The excitation information is updated only once per frame. More particularly, for FIG. 7's embodiment, 28 bits are utilized to define a selected optimum excitation signal model once per frame, with said 28 bits being allocated as follows: 7 bits are used to define a pitch value; 6 bits are used to define a pitch filter coefficient; 10 bits being used to designate an excitation signal model from an unvoiced codebook, and 5 bits being used to define a gain.

Excitation Model 4

Figure 8:
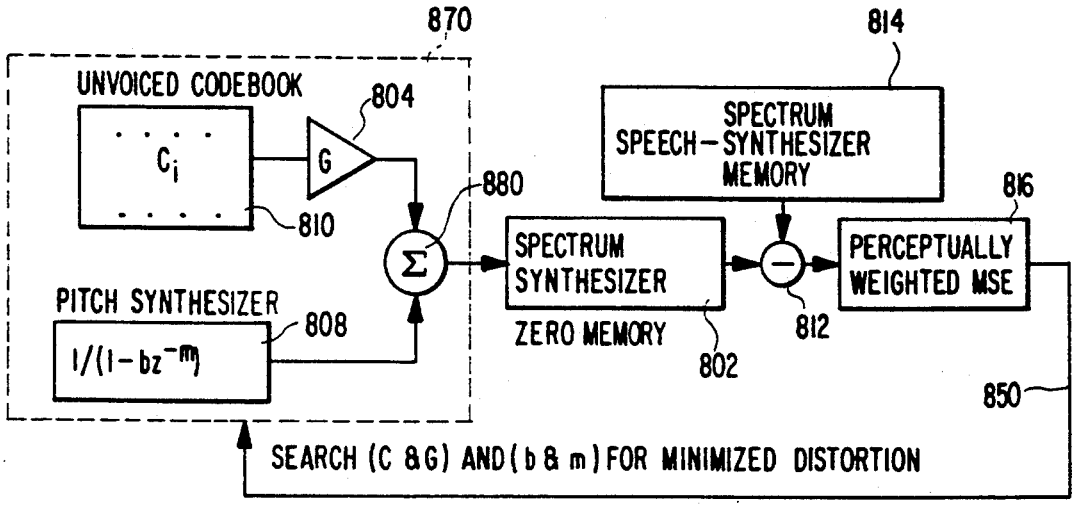
FIG. 8 is a schematic diagram of a fourth excitation model of the speech coder of the present invention.

FIG. 8 is a schematic diagram of a fourth excitation model of the speech coder of the present invention. A spectrum synthesizer 802 (e.g., a 10th-order all-pole filter), used to mimic a subject's speech generation (i.e., vocal) system, is driven by a signal from an excitation model circuit 870, to produce reconstructed speech. FIG. 8's remaining components 812, 814, 816 and 850 operate similarly to FIG. 6's components 612, 614, 616 and 650.

According to FIG. 8's embodiment, there is an unvoiced codebook 810 of 128 different random Gaussian sequences the output of which is delivered to a gain amplifier 804. FIG. 8's embodiment is somewhat similar to FIG. 6's embodiment in that a pitch synthesizer 808 is included instead of a voiced codebook. The excitation signal is formed by using a summer 880 and summing the selected random sequence output from the gain amplifier 804 and the selected pitch synthesizer signal output from the pitch synthesizer 808. For the closed-loop excitation analysis, a sequential procedure is used. This procedure first assumes zero input to the pitch synthesizer and employs the closed-loop pitch synthesizer analysis method to compute the parameters m and b. Parameters m and b are fixed, and the response of the spectrum synthesizer due to the pitch synthesizer as the source is subtracted from the original speech. A closed-loop method is then used to find the best excitation random sequence ($C_i$) and compute the corresponding gain (G).

The bit assignment for this scheme is as follows: 10 bits are used to specify 1,024 random sequences for the excitation codebook, 7 bits are allocated for pitch m, and 5 bits each are allocated for the power gain and the pitch synthesizer coefficient, respectively. The excitation information is updated only once per frame. More particularly, for FIG. 8's embodiment, 28 bits are utilized to define a selected optimum excitation signal model once per frame, with said 28 bits being allocated as follows: 7 bits are used to define a pitch value; 6 bits are used to define a pitch filter coefficient; 10 bits being used to designate an excitation signal model from an unvoiced codebook, and 5 bits being used to define a gain.

Excitation Model 5

Figure 9:
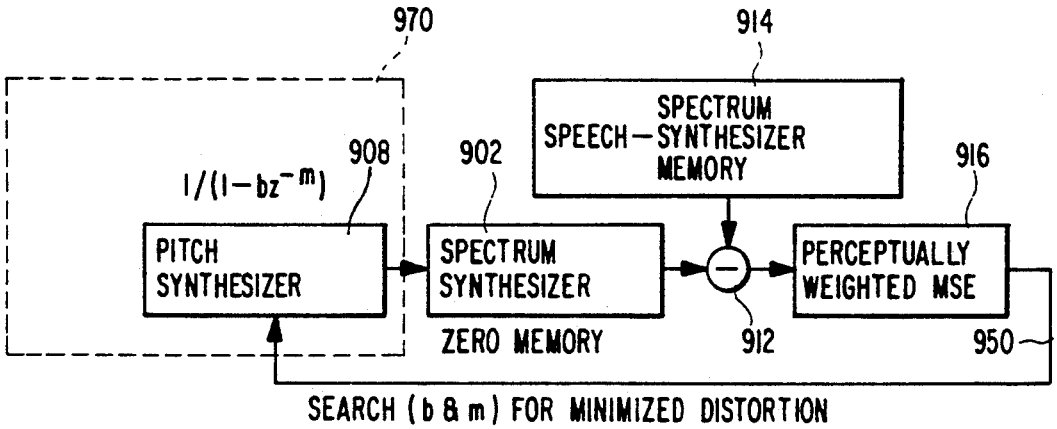
FIG. 9 is a schematic diagram of a fifth excitation model of the speech coder of the present invention.

FIG. 9 is a schematic diagram of a fifth excitation model of the speech coder of the present invention. FIG. 9's embodiment is arranged similarly to FIG. 7's, with the change that the excitation model circuit 970 comprises only a pitch synthesizer 908, and excludes FIG. 7's gain amplifier 704 and sub-excitation model circuit 770'.

The excitation model of FIG. 9 uses the pitch filter memory as the only excitation source. The pitch filter is a first-order filter, and is updated twice per frame. Each candidate excitation signal corresponds to a different pitch memory signal due to a different pitch lag. To achieve the interpolation effect of a third-order pitch filter, fractional pitch values (see Kroon, supra.) are included. Nine bits are allocated to specify 256 different integer and fractional pitch lags, and 256 center-clipped versions of the excitation signal corresponding to these pitch lags. The best choice of the excitation signal is found by the analysis-by-synthesis method which minimizes the WMSE distortion measure directly between the original and the reconstructed speech. As the pitch filter memory varies with time, the excitation codebook becomes an adaptive one.

Accordingly, 28 bits are utilized to define a selected optimum excitation signal model twice per frame, with each of two 14 bit groups of said 28 bits being allocated as follows: 1 bit being used to designate one of normal and center-clipped excitation signals; 8 bits are used to define a pitch value; and 5 bits are used to define a pitch filter coefficient.

In conclusion, the approach of the subject invention provides improved performance over the standard LPC-10 approach. The voiced/unvoiced decision and the estimated pitch in the corresponding excitation models are optimized through an analysis-by-synthesis procedure. A perceptual weighting effect which is absent in the LPC-10 approach is also added. The complexity of the subject invention is increased over that of the standard LPC-10; however, implementation of the same is well within the capability of DSP chips. Accordingly, the subject invention is of importance for low bit rate voice codecs.

What is claimed is:

1. A linear predictive speech codec arrangement for performing a closed loop analysis-by-synthesis operation, comprising:

an excitation model means for generating a plurality of excitation signals comprising voiced excitation generator means in the form of a codebook for providing a plurality of possible pulse trains for use as an excitation signal; and Gaussian noise generator means in the form of a codebook for providing a plurality of possible random sequences for use as an excitation signal, wherein said voiced excitation generator means and said Gaussian noise generator means are provided in parallel arrangement;

sequencing means, coupled to an output of said voiced excitation generator means and said Gaussian noise generator means, for providing all possible pulse trains and random sequences in sequence as possible excitation signals;

spectrum synthesizer means, coupled to said sequencing means, for providing reconstructed speech generation in response to each of said plurality of excitation signals;

distortion analyzer means, coupled to an output of said spectrum synthesizer means, for comparing said reconstructed speech with original speech, and providing a distortion analysis signal for each of said excitation signals; and means for comparing the distortion analysis signal for each of said excitation signals and selecting the excitation signal that produces the reconstructed speech with a minimum distortion analysis signal so as to provide optimal reconstructed speech.

2. A speech codec arrangement as claimed in claim 1, further comprising:

output means for providing, for speech reconstruction at decoder means, coded output signals according to a 54 bit per speech frame coding scheme, wherein 26 bits are used to define parameters for said spectrum synthesizer means once per frame, and 28 bits are utilized to define a selected optimum excitation signal model twice per frame, with each of two 14 bit groups from said 28 bits being allocated as follows: 1 bit to designate one of a voiced and unvoiced excitation model; if a voiced model is designated, 7 bits are used to define a pitch value and 6 bits are used to define a gain; and, if an unvoiced model is designated, 8 bits being used to designate an excitation signal model from an unvoiced codebook, and 5 bits being used to define a gain; and, decoder means for receiving and utilizing said coded output signals, for producing said optimal reconstructed speech.

3. A speech codec arrangement as claimed in claim 1 wherein said distortion analyzer means comprises:

residual speech means for providing a residual speech which negates effects induced by a memory of said spectrum synthesizer means before a reconstructed speech comparison is performed; and, subtractor means for receiving a reconstructed speech and subtracting therefrom, said residual speech delivered from said residual speech means.

4. A speech codec arrangement as claimed in claim 1 wherein said distortion analyzer means comprises:

perceptual weighting means which introduces a perceptual weighting effect on the mean-squared-error distortion measure with regard to a reconstructed speech.

5. A speech codec arrangement as claimed in claim 1, wherein said spectrum synthesizer means is a 10th-order all-pole filter.

6. A linear predictive speech codec arrangement for performing a closed loop analysis-by-synthesis operation, comprising:

an excitation model means for generating a plurality of excitation signals comprising voiced excitation generator means in the form of a first order pitch synthesizer for providing a plurality of possible voiced excitation signals for use as an excitation signal; and Gaussian noise generator means in the form of a codebook for providing a plurality of possible random sequences for use as an excitation signal, wherein said voiced excitation generator means and said gaussian noise generator means are provided in parallel arrangement;

sequencing means, coupled to an output of said voiced excitation generator means and said Gaussian noise generator means, for providing all possible pulse trains and random sequences in sequence as possible excitation signals;

spectrum synthesizer means, coupled to said sequencing means, for providing reconstructed speech generation in response to each of said plurality of excitation signals;

distortion analyzer means, coupled to an output of said spectrum synthesizer means, for comparing said reconstructed speech with original speech, and providing a distortion analysis signal for each of said excitation signals; and means for comparing the distortion analysis signal for each of said excitation signals and selecting one of said possible random sequences, or selecting a pitch value and pitch filter coefficient of said first order pitch synthesizer so as to provide optimal reconstructed speech.

7. A speech codec arrangement as claimed in claim 6, further comprising:

output means for providing, for speech reconstruction at decoder means, coded output signals according to a 54 bit per speech frame coding scheme, wherein 26 bits are used to define parameters for said spectrum synthesizer means once per frame, and 28 bits are utilized to define a selected optimum excitation signal model twice per frame, with each of two 14 bit groups from said 28 bits being allocated as follows: one bit to designate one of a voiced and unvoiced excitation model; if a voiced model is designated, 7 bits are used to define a pitch value and 6 bits are used to define a pitch filter coefficient; and, if an unvoiced model is designated, 8 bits being used to designate an excitation signal model from an unvoiced codebook, and 5 bits being used to define a gain; and, decoder means for receiving and utilizing said coded output signals, for producing said optimal reconstructed speech.

8. A linear predictive speech codec arrangement for performing a closed loop analysis-by-synthesis operation, comprising:

an excitation model means for generating a plurality of excitation signals comprising voiced excitation generator means in the form of a first order pitch synthesizer for providing a plurality of possible voice excitation signals for use as an excitation signal; and Gaussian noise generator means in the form of a codebook for providing a plurality of possible random sequences for use as an excitation signal, wherein said voice excitation generator means and said Gaussian noise generator means are provided in parallel arrangement;

sequencing means, coupled to an output of said voiced excitation generator means and said Gaussian noise generator means, for providing all possible pulse trains and random sequences in sequence as possible excitation signals;

spectrum synthesizer means, coupled to said sequencing means, for providing reconstructed speech generation in response to each of said plurality of excitation signals;

distortion analyzer means, coupled to an output of said spectrum synthesizer means, for comparing said reconstructed speech with original speech, and providing a distortion analysis signal for each of said excitation signals; and means for comparing the distortion analysis signal for each of said excitation signals and selecting one of said possible random sequences and a pitch value and pitch filter coefficient of said first order pitch synthesizer, and computing a summation of excitation signals according to the selected random sequence and pitch value and pitch filter coefficient so as to provide optimal reconstructed speech.

9. A speech codec arrangement as claimed in claim 8, further comprising:

output means for providing, for speech reconstruction at decoder means, coded output signals according to a 54 bit per speech frame coding scheme, wherein 26 bits are used to define parameters for said spectrum synthesizer means once per frame, and 28 bits are utilized to define a selected optimum excitation signal model once per frame, with said 28 bits being allocated as follows: 7 bits are used to define a pitch value; 6 bits are used to define a pitch filter coefficient; 10 bits being used to designate an excitation signal model from an unvoiced codebook, and 5 bits being used to define a gain; and, decoder means for receiving and utilizing said coded output signals, for producing said optimal reconstructed speech.

* * * * *